United States Patent [19]

Eisenhardt, Jr.

[11] 4,422,824

[45] Dec. 27, 1983

[54] GERMICIDAL CEILING FAN BLADE

[76] Inventor: Charles A. Eisenhardt, Jr., 1051 Sugar Sands Blvd., Riviera Beach, Fla. 33404

[21] Appl. No.: 363,260

[22] Filed: Mar. 29, 1982

[51] Int. Cl.[3] ..... F04D 29/70

[52] U.S. Cl. ..... 416/5; 416/91; 416/146 R; 55/467

[58] Field of Search ..... 416/5, 146 R, 91; 239/60; 55/383, 467, 401

[56] References Cited

U.S. PATENT DOCUMENTS

| | | | |
|---|---|---|---|
| 411,826 | 10/1889 | Murray | 416/91 |
| 1,311,811 | 7/1919 | Gough | 55/383 |
| 1,604,877 | 10/1926 | Burckhalter | 416/91 |
| 1,833,674 | 11/1931 | Fedeler | 55/401 X |
| 2,197,120 | 4/1940 | Bergmann | 55/401 X |
| 2,354,817 | 8/1944 | Law | 416/5 X |
| 3,422,263 | 1/1969 | Asahina | 55/467 X |
| 3,816,981 | 6/1974 | Carnewal et al. | 55/467 |
| 3,846,072 | 11/1974 | Patterson | 55/279 X |
| 4,292,055 | 9/1981 | De Castella et al. | 55/401 X |

FOREIGN PATENT DOCUMENTS

| | | | |
|---|---|---|---|
| 1057408 | 3/1954 | France | 416/91 |
| 385772 | 1/1933 | United Kingdom | 416/5 |
| 1265761 | 3/1972 | United Kingdom | 416/91 |

*Primary Examiner*—Everette A. Powell, Jr.
*Attorney, Agent, or Firm*—Frost & Jacobs

[57] ABSTRACT

A fan blade, preferably for use with a ceiling fan, is constructed hollow with a top and bottom located so as to provide an air space sufficiently large enough to house one or more germicidal lights, preferably ultraviolet, in such manner that the light will burn while the fan blade rotates. Filtering pads, preferably charcoal impregnated and usually comprised of a plastic foam, are located at the leading and trailing edges of the air space between the top and bottom of the hollow blade for the absorption of smoke and other objectionable odors as the air passes through the lamp area. Preferably the leading edge is provided with pocket means to receive the air. Baffles may be provided to prevent the germicidal light from casting its light outside the confines of the hollow blade. The ends of the blade joining the leading and trailing edges thereof are closed. By virtue of all of the foregoing the hollow fan blade containing the ultraviolet germicidal light is rotated at a speed sufficient to cause the air with the airborne micro-organisms therein, such as bacteria and the like, to be exposed to the germicidal ultraviolet light for a sufficient length of time and ultraviolet intensity, which may be increased by the use of reflective surfaces within the blade, to destroy 99% of the micro-organisms and bacteria contained in the passing air.

16 Claims, 2 Drawing Figures

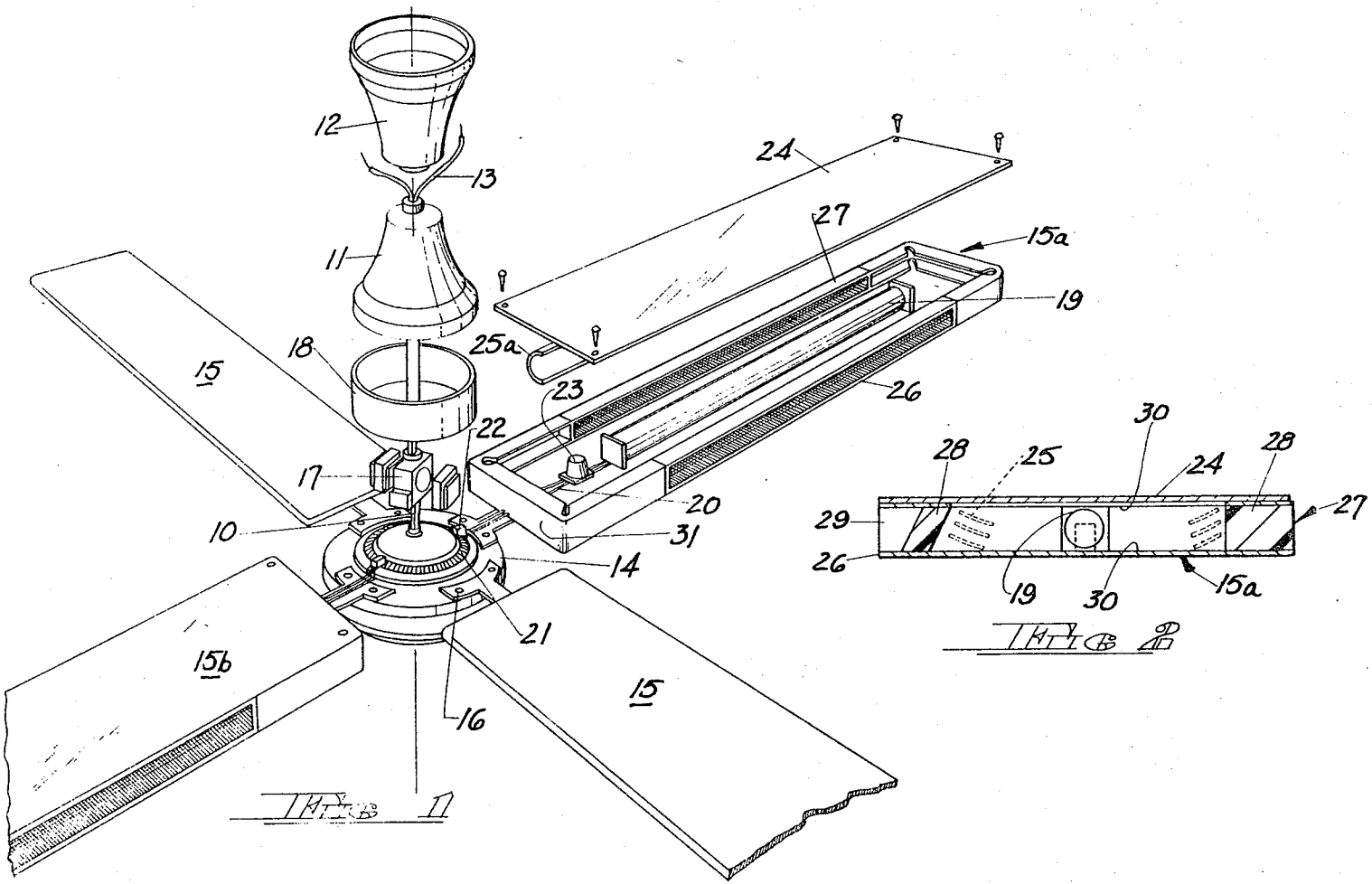
10
11
12
13
14
15
15a
15b
16
17
18
19
20
21
22
23
24
25
25a
26
27
28
29
30
31

GERMICIDAL CEILING FAN BLADE

TECHNICAL FIELD

The hollow germicidal ceiling fan blade of this invention houses an ultraviolet germicidal light in such manner that the light will burn while the fan blade rotates at a speed sufficient to cause the air with the airborne micro-organisms (bacteria and the like) therein to be exposed to the germicidal ultraviolet light for a sufficient length of time and ultraviolet intensity to destroy 99% of the micro-organisms contained in the passing air. The arrangement is particularly desirable in buildings through which large numbers of people will pass, such as restaurants, factories, food processing facilities, theatres, hospitals, doctors' offices and medical clinics; it will be apparent that it may also be utilized in homes, hotels, motels and public places of all sorts. The hollow germicidal ceiling fan blade may be provided with closed ends, charcoal impregnated filtering pads, and baffles to prevent an undue amount of ultraviolet germicidal light from being cast outside of the hollow blade. This effectively kills germs while minimizing the chance of causing any harm to human eyes or the fading of paints and fabrics. The filtering pads are located at the leading and trailing edges of the air space between the top and bottom of the hollow blade for the absorption of smoke and other objectionable odors as the air passes through the lamp area.

BACKGROUND ART

No search of the U.S. prior art patents has been made. Ultraviolet germicidal lights, however, are well known and available in the market place. The filtering pads which may be comprised of a plastic foam impregnated with charcoal, or some other form of carbon, are also known items. The inside of the top and bottom of the fan blade may be provided with a Mylar reflective surface to intensify the action of the ultraviolet germicidal light; such reflective surfaces are also known. A hollow ceiling fan blade, however, of the type shown, described and claimed herein, is not known prior to this invention. Such a blade is made with a top and bottom so arranged as to provide an air space sufficiently large to accommodate one or more germicidal ultraviolet lights, such space probably being in the neighborhood of two and one half inches high.

DISCLOSURE OF THE INVENTION

The hollow germicidal ceiling fan blade of this invention will accommodate one or more ultraviolet lights in such manner that they will burn while the fan blades rotate. Filtering pads are provided at the leading and trailing edges of the blade for absorption of smoke and other objectionable odors as the air passes through the lamp area. The interior of the hollow blade may be provided with baffles to prevent the ultraviolet germicidal light(s) from casting its light outside the confines of the hollow blade. To this end the fan blade may also be provided with closed ends to prevent the germicidal light from casting its light outside of the hollow blade through either end of the blade. The blade is attached to the ceiling fan motor so that the designed hollow space is maintained under all operating conditions. The hollow fan blade or blades containing the germicidal light or lights rotate at a speed sufficient to cause the air with the airborne micro-organisms therein to be exposed to the germicidal light for a sufficient length of time and ultraviolet intensity to destroy 99% of the micro-organisms contained in the passing air.

BRIEF DESCRIPTION OF THE DRAWINGS

FIG. 1 is an exploded, perspective view, partly fragmented, of a ceiling fan having one or more hollow blades constructed in accordance with the teachings of this invention.

FIG. 2 is a section across one of the hollow blades, certain of the parts being shown in phantom.

DETAILED DESCRIPTION OF THE INVENTION

A hollow rod or pipe stem 10 is affixed to fixtures 11 and 12 in such manner that the ceiling fan and its rotating blades may be supported from the ceiling of the room in which the fan and blades are mounted, the electrical connections coming through the ceiling and terminating in wires 13 which are housed within the rod 10. A well known pancake-type motor (not shown) is mounted on the lower end of the rod 10 so as to rotate, when energized, the movable shell 14 to which the fan blades 15 are attached as indicated at 16. There are four of the blades 15 in the particular arrangement depicted, the blades **15*a* and 15*b* being hollow blades in accordance with the teachings of this invention while the other two blades 15** are the normal, flat solid blades one usually finds with ceiling fans of the general type under consideration.

A transformer or ballast 17 is mounted on the stationary section of the fan mechanism as represented by the rod 10 and its associated parts; this transformer is housed within a ring 18 and is used to reduce the current to the level required for the particular germicidal light 19 employed. The light 19 is connected by wires 20 to a copper band or brass ring 21 supplied with electric current via the transformer 17. The electrical connection between the wires 20 and ring 21 may be maintained by means of a spring biased brush 22 so that the light 19 will burn while the fan blade **15*a* rotates. A starter 23 may be employed if required. Connections like that generally indicated in connection with the wires 20, ring 21 and brush 22** are known in the art and, therefore, are not illustrated in detail.

Although the fan of this invention is being described as having four blades, which is common for ceiling fans of the type to which the instant invention is applied, it will be understood by those skilled in the art that other numbers may be employed. And while two of the blades are illustrated as hollow in accordance with the teachings of this invention, it may be possible to apply the invention to two or more of the blades. It is important to maintain a proper balance to the fan so that it will operate smoothly. The ceiling fan to which the invention is applied is of the type that moves a large volume of air at relatively slow speeds.

The light depicted at 19 is a germicidal ultraviolet light. A single such light is shown as housed within the hollow blade **15*a*. That blade should have a removable top 24 so that the light 19 may be cleaned or changed when that becomes necessary. It may be that other germicidal lights can be utilized. The ultraviolet light, however, works very well and is readily available in the market place. This light should have an ultraviolet light output watts of 2537 A (angstrom units). Such lights, however, do have the ability not only to destroy germs effectively but they also can harm human eyes, fade paints and damage fabrics and growing plants. Because of this, there are certain standards, set by law, as to the maximum radiation emission which may be permitted to be disseminated. In order to help control this and keep the radiation emission within the desired limits, one or more baffles 25 may be employed to cut down radiation through the leading edge 26 and trailing edge 27 of the blade 15***a*. An alternative form of baffle is indicated at 25*a*.

Charcoal impregnated filtering pads 28 may be installed at the leading and trailing edges 26 and 27 of the hollow blade 15*a* for the absorption of smoke and other objectionable odors as the air passes through the lamp area. That filtering pad 28 which is at the leading edge 26 of the hollow blade 15*a* is preferably recessed or inset within the hollow blade so as to provide an area 29 which serves to scoop up the air as the blade 15*a* rotates in a clockwise direction as viewed in FIG. 1. It may also be desirable to locate one or the other, or both, of the filtering pads 28 at an angle other than 90 degrees with respect to the top and bottom walls of the blade 15*a* so as to tend to direct the light at an angle, preferably upwardly, to aid in cutting down the quantity of light which is diffused from the blade containing the germicidal light. As indicated, the filtering pads are preferably made from a plastic foam impregnated with charcoal; such pads are porous enough that one may see light through them. Nevertheless it is believed that the pads will aid in cutting down the amount of light which escapes from the blade, particularly if they are slanted so as to direct the light to the upper portion of the blade interior.

It may also be desirable to apply a Mylar reflective surface 30 to the interior sides of the top and bottom walls of the hollow blade 15*a*. These reflective surfaces 30 serve to intensify the action of the germicidal light; the light coming off such surfaces is about as effective in its germicidal action as is the light stemming directly from the light 19 itself. Reflective surfaces other than Mylar may be utilized.

The ceiling fan illustrated in FIG. 1 is depicted as being of the four blade type, two opposed blades 15*a* and 15*b* having been modified in accordance with the teachings of this invention. It would be posssible to construct all four blades in like manner. It is believed, however, that two will suffice. In any event, regardless of whether the invention is applied to but one of the blades, two as indicated, or all, it is necessary to cause the hollow fan blade(s) containing the ultraviolet germicidal light(s) to rotate at a speed sufficient to cause the air with the airborne micro-organisms therein to be exposed to the germicidal ultraviolet light(s) for a sufficient length of time and ultraviolet intensity to destroy 95% or more of the micro-organisms contained in the passing air scooped up at the area 29.

The opposed ends 31 of the hollow blade are closed so as to prevent the ultraviolet germicidal light 19 from casting its light outside of the hollow blade through either end of the blade. The baffles 25, and to some extent the filtering pads 28, also serve to contain the effective light from the germicidal light 19 within the confines of the hollow blade so that a maximum amount of air is exposed to the germicidal light; it is believed that an exposure of three or four milliseconds will suffice to destroy practically all of the micro-organisms contained in the air passing through the hollow blade from the area 29, past the leading filtering pad 28 and baffles 25, and exiting through the trailing pad 28 adjacent the trailing edge 27 of the hollow blade 15*a*. The pad 28 adjacent the trailing edge 27 is preferably located at the edge rather than is it inset as is the case with the pad 28 near the leading edge 26. Although not shown, it would be possible to substitute some sort of precipitator, probably electrostatic, for one or both of the charcoal impregnated filtering pads 28.

Ceiling fans are usually installed near the center of the room ceiling and the convection air current in a room usually rises at the perimeter walls, having been warmed by heating devices near or in the walls and by heat radiated by the walls, to the ceiling. Thus, a ceiling fan with ultraviolet light will take the warm, germ laden air, pass it through the hollow blades and push the cleansed air downwardly toward the floor, thus assisting the natural convection air currents.

It will be understood by those skilled in the art that modifications may be made in this invention without departing from its scope. Possible modifications could include a separate electrical circuit with its own separate switch (not shown) to allow the germicidal ultraviolet light to remain turned off while the fan may be used as a regular ceiling fan without the germicidal function. And a green glass jewel (not shown) could be placed in the lower half of the hollow blade to indicate whether the ultraviolet germicidal light is turned on or off.

Furthermore, while the germicidal fan blade has been illustrated as being applied to a ceiling fan, it would be possible to incorporate such a blade in other fans. The ceiling fan, however, does lend itself quite nicely to the invention because such fans move a large volume of air at relatively slow speeds and this makes it possible to treat effectively the air within the enclosure wherein the fan is located. The inside of the rotatable shell 14 may be provided with a magnetic field so that the shell travels around the pancake-type motor (not shown but well known) mounted on the pipe 10. The copper band or brass ring 21 electrically connected to the transformer 17 is in turn contacted by the spring biased brush 22 so as to insure that the light 19 will burn while the blades 15 are rotating.

It is also to be understood that while the invention has been shown and described in terms of particular structures, components and arrangements, the invention is not to be limited to such particular structures, components and arrangements except insofar as they are specifically set forth in the subjoined claims.

I claim:

1. A fan blade comprising: a hollow housing having leading and trailing edges through which air may pass; a germicidal light located within said housing; and means to insure that said light will burn as the fan blade rotates.

2. The blade of claim 1 adapted for use with a ceiling fan which moves a relatively large amount of air at a relatively slow speed; and said germicidal light is ultraviolet with an ultraviolet light output watts of 2537 A (angstrom units).

3. The blade of claim 2 having closed ends impervious to the light emitted from said germicidal light, and filtering pads located adjacent said leading and trailing edges, said filtering pads permitting air to pass therethrough.

4. The blade of claim 3 in which the filtering pad adjacent said leading edge is inset therefrom so as to provide an air receiving pocket.

5. The blade of claim 3 in which said housing is provided with reflective interior upper and lower surfaces to intensify the light emitting from said germicidal light within the confines of said housing.

6. The blade of claim 3 including baffles to shield the light emitting from said germicidal light so that only that amount of ultraviolet radiation permitted by law escapes from said housing.

7. The blade of claim 3 in which said filtering pads are comprised of plastic foam impregnated with carbon.

8. The blade of claim 3 in which said filtering pads are charcoal impregnated.

9. A ceiling fan blade having a hollow interior defined by top and bottom walls, closed ends, and a leading edge and a trailing edge through which air may pass; a germicidal ultraviolet light located within said hollow interior so that light emitting from said germicidal light contacts the air passing through said hollow interior; means to insure that said germicidal light will burn while said ceiling fan blade rotates; and charcoal impregnated filtering pads at said leading and trailing edges, between said top and bottom walls, for the absorption of smoke and other objectionable odors as air passes through said hollow interior from said leading edge to said trailing edge.

10. The ceiling fan blade of claim 9 in which the filtering pad at said leading edge is inset therefrom so as to define an air receiving pocket.

11. The ceiling fan of claim 9 in which baffles are provided to shield the light emitting from said germicidal ultraviolet light so that undue amounts of radiation do not escape from said hollow interior.

12. The ceiling fan blade of claim 9 in which the interior sides of said top and bottom walls are provided with a reflective surface to intensify the light within said hollow interior.

13. The ceiling fan blade of claim 9 in which the filtering pad at said leading edge is inset therefrom so as to define an air receiving pocket; baffles are provided to shield light emitting from said germicidal ultraviolet light so that undue amounts of radiation do not escape from said hollow interior; and the interior sides of said top and bottom walls are provided with a reflective surface to intensify the light within said hollow interior.

14. The ceiling fan blade of claim 9 including a separate electrical circuit with its own separate switch to allow said germicidal ultraviolet light to remain turned off while said blade may be used as a regular blade without the germicidal function.

15. The blade of claim 14 including a green glass jewel placed in the lower half of the hollow blade to indicate whether said ultraviolet germicidal light is turned on or off.

16. A method of causing air with airborne micro-organisms therein to be exposed to germicidal ultraviolet light for a sufficient length of time and ultraviolet intensity to destroy 95% or more of the micro-organisms contained in the air, which method comprises the steps of locating a germicidal ultraviolet light within a hollow ceiling fan blade in such manner that the light will burn while the fan blade rotates, and causing said hollow ceiling fan blade to rotate.

* * * * *